United States Patent [19]

Ihata

[11] Patent Number: 4,615,118

[45] Date of Patent: Oct. 7, 1986

[54] MAGAZINE TYPE KNIFE

[75] Inventor: Sachiko Ihata, Osaka, Japan

[73] Assignee: Nippon Tenshashi Kabushiki Kaisha, Japan

[21] Appl. No.: 698,505

[22] Filed: Feb. 5, 1985

[30] Foreign Application Priority Data

Jul. 16, 1984 [JP] Japan ..... 59-107962[U]

[51] Int. Cl.[4] ..... B26B 29/00

[52] U.S. Cl. ..... 30/151; 30/152; 30/162; 30/335

[58] Field of Search ..... 30/151, 152, 162, 164, 30/335

[56] References Cited

U.S. PATENT DOCUMENTS 2,709,299 5/1955 Vizza ..... 30/162 X
4,277,888 7/1981 Szabo ..... 30/162

FOREIGN PATENT DOCUMENTS 48-94229 2/1972 Japan .
5064100 10/1973 Japan .
50-8840 4/1975 Japan .
5272200 11/1975 Japan .
52-4640 1/1977 Japan .
53-44800 10/1978 Japan .
54-16880 6/1979 Japan .
57-51010 11/1982 Japan .

*Primary Examiner*—Fred Silverberg
*Assistant Examiner*—Willmon Fridie, Jr.
*Attorney, Agent, or Firm*—Griffin, Branigan, & Butler

[57] ABSTRACT

A magazine type knife has a magazine which can be fitted in and removed from a magazine storage cavity formed in a main body of the knife. The magazine comprises a magazine case, a base plate, a first elastic body and a second elastic body, all of which are inseparably assembled together, but with which, when the magazine is removed from the main body, the second elastic body is freed to cease to press a forward end portion of the base plate toward a left wall side of the magazine case, thereby making it easy to insert blades into the magazine case.

5 Claims, 9 Drawing Figures

1
2
3
4
5
6
7
8
9
10
11
12
13
15
17
18
19
20
21
22
23
24
25
26
27
28
30
32
33
34
35
37
38
39
40
41
42
44
46
47
48
49

MAGAZINE TYPE KNIFE

BACKGROUND OF THE INVENTION

The present invention relates to a knife for cutting paper or synthetic resin sheets, and is more particularly concerned with improvements in a magazine type knife having a magazine in a main body for storing a plurality of blades for subsequent use.

Hitherto such knives have been known, but each of them has presented some disadvantages in its use as follows:

(1) Blade Body Direct Insertion Type

Knives of this type allow the direct insertion of a plurality of blade bodies into a main knife body at the same time, as disclosed, for instance, in Utility Model Application laid open No. 52-72200.

With the knives of this type, insertion of the blade bodies is extremely difficult due to the fact that insertion has to be performed against elastic pressure since an elastic body is installed in the main body.

(2) Magazine Type with which disassembling cannot be performed, and an elastic body is incorporated inside the magazine.

With knives of this type, a magazine storing a plurality of blade bodies is fitted inside the main body, and is constructed so as not to be disassembled. An elastic body pressing against the blade bodies is installed inside the magazine. These types were initially designed so that the magazine is disposable. However, the magazine can be refilled with new blade bodies by a user, as disclosed, for instance, in Patent Publication No. 50-8840, Utility Model Publication No. 53-44800 and Utility Model Publication No. 54-16880.

With knives of this type, just as with the knives of the Blade Body Direct Insertion Type, insertion of the blade bodies is extremely difficult due to the fact that insertion has to be performed against an elastic body incorporated inside the magazine.

(3) Magazine Type with which disassembling cannot be performed, and an elastic body is outside the magazine.

With knives of this type, a magazine storing a plurality of blade bodies is fitted inside the main body, and is so constructed that it cannot be disassembled. An elastic body to press the blade bodies is installed in the main body. Such magazines are normally designed to be disposable. However, the magazine can be refilled with new blade bodies by a user, as disclosed, for instance in Utility Model Publication No. 57-51010.

With knives of this type, insertion of blade bodies is easily performed since there exists no elastic body. However, due to the fact that an elastic body does not exist, blade bodies are not kept secured but float inside the magazine until it is fitted to the main body, thus resulting in possible damage to the edge portions of the blade bodies.

(4) Magazine Type with which assembling can be performed, and an elastic body is incorporated inside the magazine.

With knives of this type, a magazine storing a plurality of blade bodies is fitted inside the main body. The magazine is initially so designed that it can be disassembled and refilled with a plurality of new blade bodies at the same time by a user, as disclosed, for instance, in Utility Model Application Laid Open Nos. 48-94299 and 50-64100.

With knives of this type, insertion of blade bodies can performed with ease, but the components of a magazine might be easily misplaced or assembly can be wrongly done by a user.

(5) Magazine Type with which assembling can be performed and an elastic body is incorporated outside the magazine.

With knives of this type, a magazine storing a plurality of blade bodies is fitted inside the main body, and is so constructed that it can be disassembled. An elastic body to press the blade bodies is installed in the main body. The magazine is initially so designed that it can be disassembled and refilled with a plurality of new blade bodies at the same time by a user, as disclosed, for instance, in Utility Model Publication No. 52-4640.

With knives of this type, insertion of blade bodies can be performed with ease, while the components of a magazine might be easily misplaced or assembly can be wrongly done by a user, and possible damage of the edge portion of the blade bodies might be caused because each blade body is not kept secured but floats inside the magazine until it is fitted to the main body.

As aforementioned, in conventional knives, there have been advantages as well as disadvantages.

SUMMARY OF THE INVENTION

The present invention contemplates the provision of an improved cutting tool to solve the aforementioned problems.

It is an object of the present invention to provide a magazine type knife which enables easy insertion of blade bodies, elminates possible damage of the edge portions of blade bodies and avoides mistakes in assembling a magazine as well as misplacement of components.

According to the present invention, an elongated type knife is provided with a main body having a magazine storage cavity running through its inside from a rear end, there being an opening for blade bodies at a forward end which is in communication with the magazine storage cavity.

A guide groove for a slider is also in communication with the magazine storage cavity from a left side and a slider is so fitted that it slides freely along the guide groove. A magazine is inserted into the magazine storage cavity from the rear end of the main body. The magazine comprises: a magazine case shaped roughly like a C in section and equipped with a window hole at a forward end portion of a right side wall; a base plate with elasticity inside the magazine case so as to move freely in the left and right directions, and its front half portion is curved toward the right side; a first elastic body between the base plate and the right wall of the magazine case at their rear end portions so as to press base plate toward the left side; a second elastic body between the base plate and the main body extending through the window hole on the magazine case so as to straighten the front half portion of the base plate and press it to its left side; and a plurality of blade bodies which are inserted between the left wall of the magazine case and the base plate through the front end opening of the magazine case.

Namely, there is provided a magazine which is fitted to the main body comprising the magazine case, the base plate, the first elastic body and the second elastic body which cannot be disassembled and which allows easy insertion of the blade bodies by having a front half portion of the base plate which is curved toward the right wall side of the magazine case in the state in which the magazine is removed from the main body.

When all the blade bodies have been used, the magazine is removed from the magazine storage cavity on the main body. By doing so, the second elastic body is released and thus the front half portion of the base plate curves toward the right wall side of the magazine case, and its front end almost makes contact with the right side wall of the magazine case while the rear half portion of the base plate touches the left side wall of the magazine case by means of the first elastic body installed between the base plate and the right wall of the magazine case.

Next, a plurality of blade bodies are inserted into the magazine case through its front end opening. The blade bodies, guided by the curved front half portion of the base plate, are inserted between the base plate and the left wall of the magazine case and kept pressed with the first elastic body after insertion.

A magazine such as this is fitted to the magazine storage cavity from the rear end of the main body. A part of the second elastic body touches the main body, enabling pressing forces to work on the entire area, thus straightening the front half portion of the base plate, to press it toward the left side.

Thus the blade bodies are properly pressed by means of the first and second elastic bodies, and each blade body stored inside the magazine is advanced with a slider for subsequent use.

DETAILED DESCRIPTION OF THE INVENTION

Figures 1, 2:
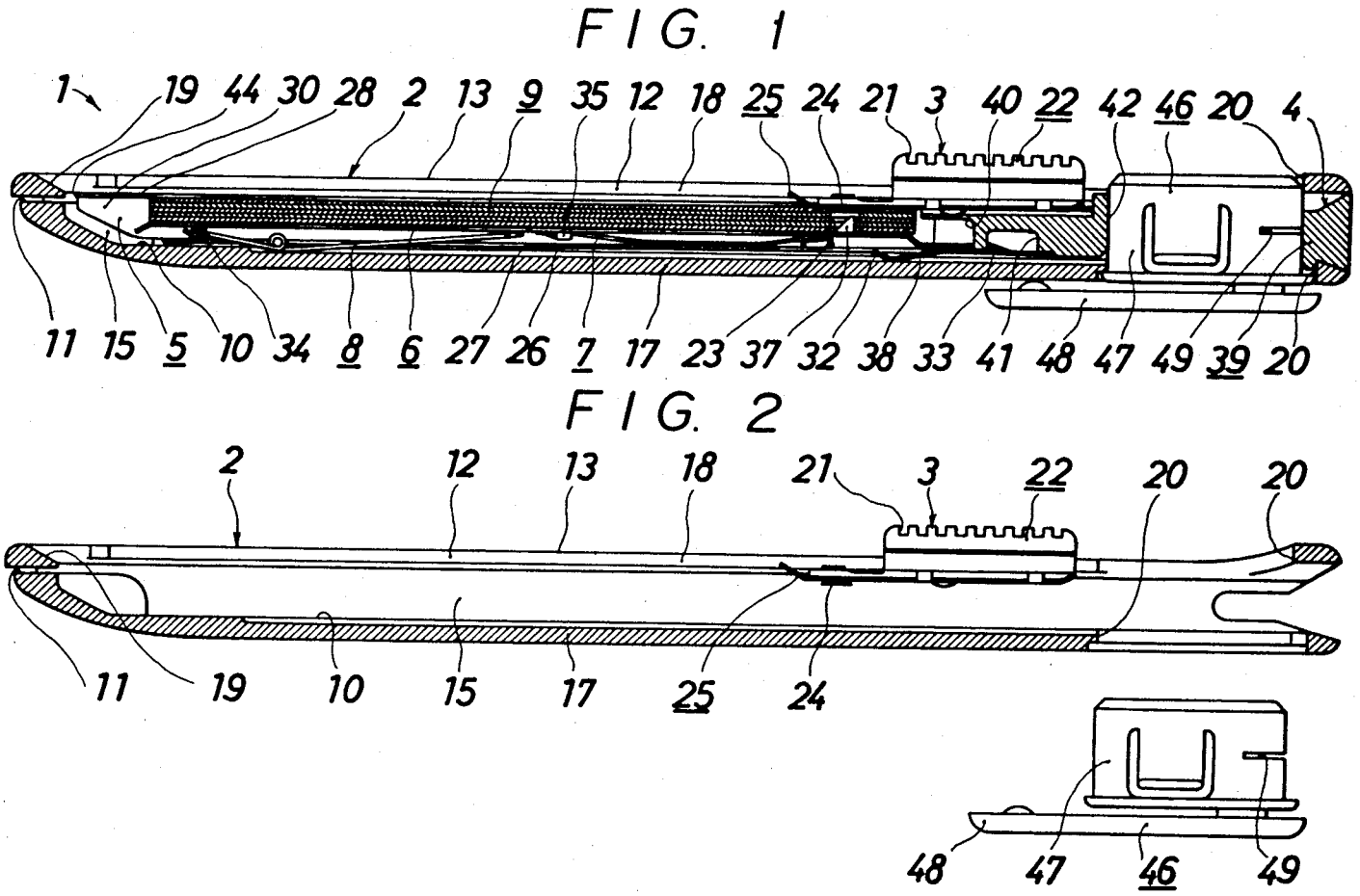
FIG. 1 is a bottom sectional view to illustrate the construction of a magazine type knife embodying the present invention.
FIG. 2 is a simplified bottom sectional, exploded, view illustrating the knife with its magazine removed.

A magazine type knife 1 comprises a main body 2, a slider 3 and a magazine 4. The main part of the magazine 4 is comprised of a magazine case 5, a base plate 6, a first elastic body 7, a second elastic body 8 and blade bodies 9.

A main body 2 is equipped with a magazine storage cavity 10 running through the inside from the rear end, a blade opening 11 for blade bodies at the forward end which is in communication with the magazine storage cavity 10, and a guide groove 12 for the slider 3 which is also in communication with the magazine storage cavity 10 on a left (right as viewed in the bottom view of FIG. 1) side respectively.

The main body 2 is integrally formed with synthetic resin. The portion excluding the forward and rearward portions is shaped roughly like a C in section with an upper left side wall 13, a lower left side wall 14, an upper wall 15, a lower wall 16 and a right side wall 17. A magazine storage cavity is formed inside the main body 2 and the guide groove 12 for the sliders is formed between the upper and lower left side walls 13 and 14. Wave-shaped projections 18 are at the lower edge of the upper left wall 13 respectively.

At the forward portion of the main body 2, the upper and lower left side walls 13, 14 are connected together, behind which is formed a slant part 19. The upper and lower left side walls 13, 14 are connected together, and there is formed a fitting hole 20 which is in communication with the upper and lower left side walls 13, 14 and the right side wall 17.

The slider 3 is fitted to the guide groove 12 to form a slider of the main body 2 for moving forwardly and rearwardly to move a blade body 9.

The slider 3 made, for example, of synthetic resin comprises: a crown 22 having a surface with projections and recesses 21; a sliding plate 25, made for example with a spring steel to be compatible with the crown 22 and having at its foremost end a bend toward the left side, the central portion of which has a projection 24 (FIG. 2) toward the right side to fit a hole 23 of a blade body 9; and a roughly reverse V-shaped spring plate (not illustrated) provided inside the crown 22, the top portion of which is projected from the upper part of the crown 22 so as to fit the wave-shaped projections 18 of the main body 2. The slider 3 is fitted to the guide groove 12 through the fitting hole 20 of the main body 2.

The magazine 4, which comprises the magazine case 5, the base plate 6, the first elastic body 7, the second elastic body 8 and blade bodies 9, is inserted into the magazine storage cavity 10 through the rearward end of the main body 2. The magazine case 5, shaped roughly like a C in section, is provided with a window hole 27 on the front end portion of the right wall 26.

The magazine case 5, made for example for a steel plate, is provided with an upper left side wall 28, a lower left side wall 29, an upper wall 30, a lower wall 31 and a right side wall 26. There are formed the window hole 27 on the front end of the right side wall 26, a flap 32 projecting toward the right side on the right side wall and a stopper 33 behind the flap 32 respectively.

The base plate 6 which is elastic is provided inside the magazine case 5 to move freely in the rightward and leftward directions, the front half portion of which is bent toward the right side.

The base plate 6, made for example of a spring steel plate, has a connector 34 at its front end, a securing member 35 at the center and a flap 36 at the rear end being defined by a roughly U-shaped cut way. A lug 37 projects toward the left side at the foremost end of the flap 36 and a roughly L-shaped hook 38 is on the rear end of the base plate 6.

The base plate is thus supported in the magazine case 5 by means of a cap 39.

The cap 39 made, for example, of synthetic resin and shaped roughly like a T, is provided with a recessed catch 40 which, with the cap 39, move freely toward the front and rear directions so as to be hooked with the hook 38 of the base plate 6. A recessed part 41 is fixed to the stopper 33 of the magazine case by bending it toward the left side and a hole 42 connects with a fitting hole 20 of the main body 2 on its rear end. Stoppers 43 are above and below the rear portion respectively.

The first elastic body 7 is installed between the base plate 6 and the right side wall 26 of the magazine case 5 at its rear end so as to press the base plate 6 toward the left side.

With this embodiment, a reverse V-shaped plate spring is employed, one end of which is fixed onto the right face of the base plate 6 by means of the securing member 35, and the summit and the other end of which touch the front face of the right wall 26 and the right face of the base plate 6 respectively.

The second elastic body 8 is installed between the base plate 6 and the main body 2 through the window hole 27 of the magazine case 5 to straighten the front half end portion of the base plate 6 and press it toward the left side.

With this embodiment, a torsion wire spring is employed, one end of which is fixed onto the rear face of the base plate 6 by means of the connector 34 so as to move toward the directions of both left and right faces. The twisted part of the spring is projected toward the right side of the magazine case 5 through the window hole 27 and touches the right side wall 17 of the main body 2, while the other end thereof touches the right face of the base plate 6.

A blade body 9 is inserted between the left walls 28, 29 of the magazine case 5 and the base plate 6 through an opening 44 at the foremost end of the magazine case 5.

Each blade body 9 is scored on its surface to provide break lines 45 separated by equal intervals to present a new cutting edge (not illustrated) for subsequent use, and is equipped with the hole 23 on its rearward portion.

The main body 2 and the magazine 4 are fixed by means of a lock body 46, which is provided with a lock part 47 to be fitted thorugh the fitting hole 20 of the main body 2 and the hole 42 of the cap 39. A hanger part 48 is integrally constructed on the lock part 47. A rearward portion of the lock body is provided with a blade break groove 49.

The functions under such a construction will now be explained.

Refering to FIG. 1, there is illustrated a state wherein the magazine 4 accommodating a certain number of blade bodies 9 is mounted in the main body 2.

Under such a state, advancement of the slider 3 results in corresponding movement of the blade body 9 resting on the foremost left side in the magazine 4 so that the blade body 9 is projected through the blade opening 11.

When the blade body 9 in use in the cutting process has become dull or blunt, the blade portion is broken off along a scored line 45 on the blade body to present a new edge, the slider 3 being advanced to its foremost position when the first blade body 9 has been used up.

Thus, the front end portion of the sliding plate 25 of the slider 3 runs on the slant portion 19 of the main body 2, to release engagement of the projection 24 of the slider 3 with the hole 23 of the blade body 9. The blade body 9 is removed through the blade opening 11.

Now, by retreating the slider 3 to the rearmost end, the hole 23 of the second blade body 9 is engaged with the projection 24 of the slider 3.

In this manner, the blade bodies 9 are all consumed.

Figure 3:
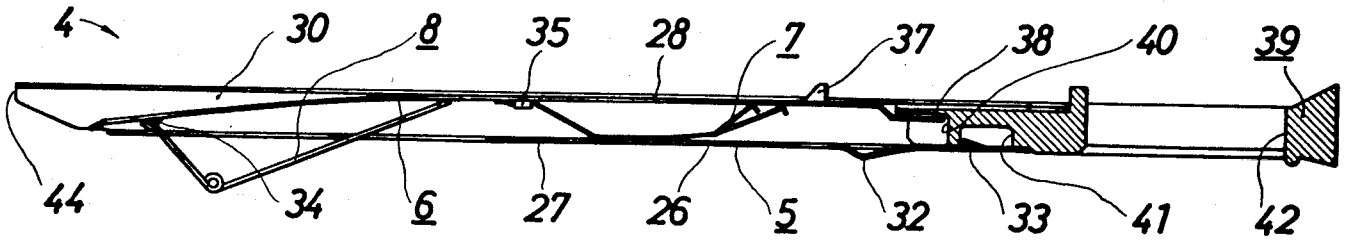
FIG. 3 is a bottom sectional view of a separated magazine.
Figure 4:
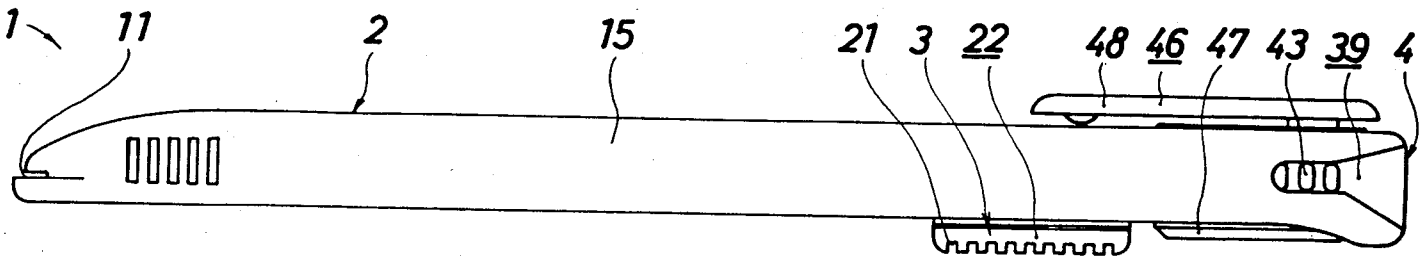
FIG. 4 is a top view of an assembled magazine type knife of this invention.
Figure 5:
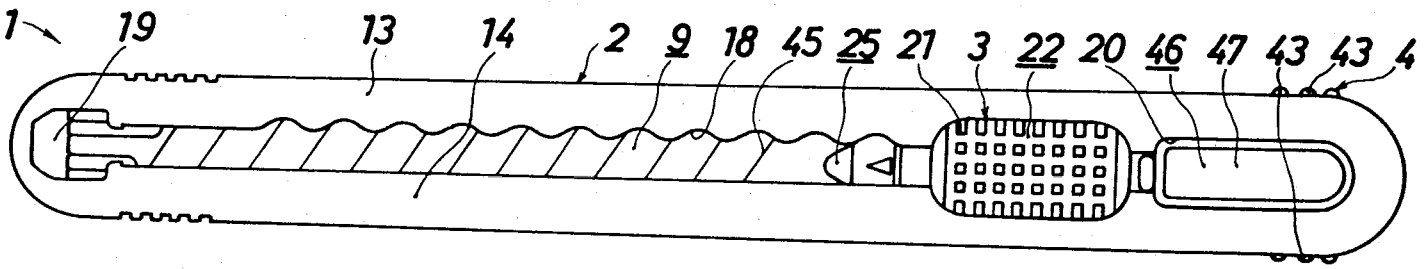
FIG. 5 is a left side view of the knife of FIG. 4.
Figure 7:
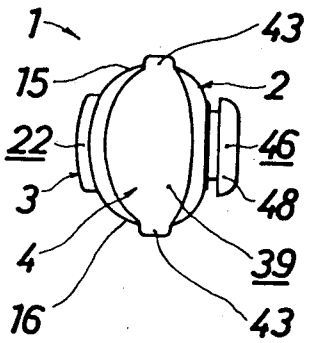
FIG. 7 is a rear end view of the knife of FIG. 5.
Figure 6:
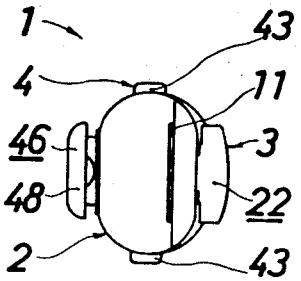
FIG. 6 is a front end view of the knife of FIG. 5.
Figure 8:
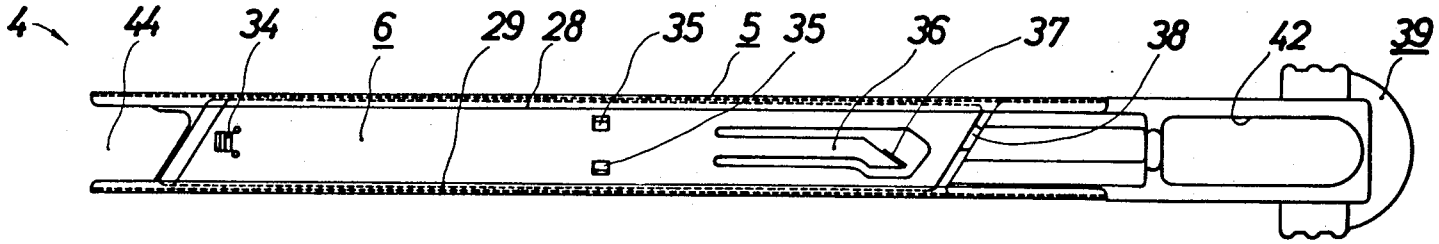
FIG. 8 is a left side view of a separated magazine.
Figure 9:
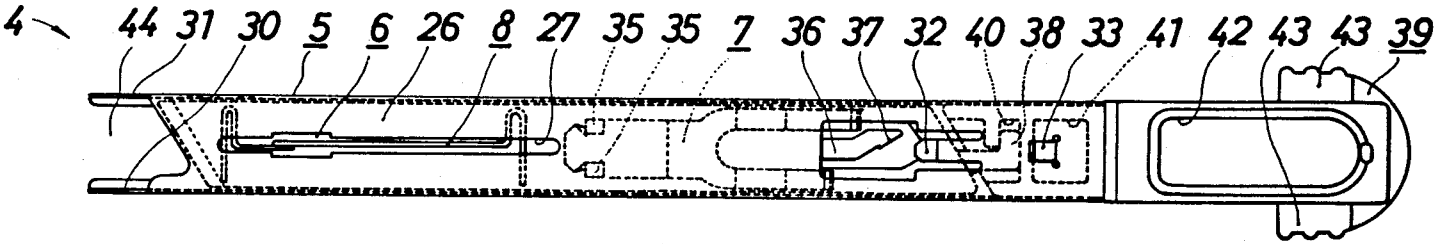
FIG. 9 is a right side view of the magazine of FIG. 8.

When all the blade bodies 9 in the magazine 4 have been used, the lock body 46 is disengaged and the magazine 4 is removed through the rear end of the main body 2. Thus, the main body 2, the slider 3 and the lock body 46 are in the state as shown in FIG. 2, and a magazine 4 is in the state as shown in FIG. 3.

Next, a blade body 9 or a certain required number of blade bodies 9 in a pile is/are inserted between the base plate 6 and left side walls 28, 29 of the magazine case 5 through the opening 44 at the foremost end of the magazine case 5.

The forward portion of the base plate 6, being bent toward the right side, allows easy insertion of the blade bodies 9.

When a blade body 9 is inserted into the magazine case 5, the lug 37 is presseed toward the right side, and fitted to the hole 23 of the blade body 9 by means of elasticity of the flap 36.

This action prevents the blade body 9 from dropping through the front end, and at the same time the blade body 9 is firmly pressed between the left walls 28, 29 of the magazine case 5 and the base plate 6 by means of elasticity of the first elastic body 7, thus preventing the blade body from floating. Thus, the edge portions of blade bodies 9 will not be damaged even when a magazine 4 storing the blade bodies is carried around.

The magazine in such a state is inserted into the magazine storage cavity 10 through the rear end of the main body 2.

The twisted part of the second elastic body 8 touches the right wall 17 of the main body 2 to thereby gain the pressing force for straightening the front half portion of the base plate 6 and pressing it toward the left side.

The magazine 4 is kept secured against the main body 2 by means of the second elastic body 8 and the flap 32 of the magazine case 5. FIG. 1 illustrates how the lock body 46 is fitted and locked in the hole 20 of the main body 2 and the hole 42 of the cap 39, thus enabling continuous use in a cutting mode.

The first and second elastic bodies 7, 8 are not limited to the aforementioned embodiments and may be replaced with other types of springs or rubber materials.

With the aforementioned embodiment, the second elastic body 8 is partially supported by the base plate 6, however, the invention does not need to be limited to this embodiment. The second elastic body 8 can be supported either by the magazine case 5 or with the main body 2.

As described above, the present invention provides excellent performances with the following advantages:

1. When a magazine is removed from the main body, the second elastic body is set free so that the front half portion of the base plate is curved toward the right side wall of the magazine case, thus resulting in easy insertion of blade bodies into the magazine.
2. The blade bodies in the magazine are firmly kept between the base plate and the left walls of the magazine case, thus preventing them from floating and eliminating damage to the edge portions of the blade bodies which might be caused by contacts with the magazine.
3. The magazine is so constructed that it is not able to be disassembled by a user, thus avoiding mistakes in assembling as well as misplacement of components.
4. When the magazine is fitted in the magazine storage cavity of the main body, the base plate, blade bodies and the magazine case are all pressed toward the left side by means of elasticity of the second elastic body, thus keeping the magazine firmly secured against the main body.

A desirable movement of a blade body can be performed due to the flawless locking of the projection of the slider with the hole of the blade body.

What is claim is:

1. A magzine type knife provided with an elongated main body which defines a magazine storage cavity running from a forward end to a rearward end thereof, an exit opening for blade bodies at the forward end thereof which is in communication with the magazine storage cavity, and a slider guide groove which is provided on a left side of the main body and is also in communication with the magazine storage cavity;

a slider which is so mounted on the guide groove that it slides freely along the groove of the main body; and, an elongated magazine which is inserted into the magazine storage cavity from the rear end of the main body, characterized by structure comprising:

a magazine case shaped roughly like a C in section and equipped with a window hole at a forward end portion of a right side wall;

a base plate placed inside the magazine case and being elastically flexible toward the right and left directions with its forward end portion being curved toward the right side wall;

a first elastic body installed between the base plate and the right side wall of the magazine case at their rear end portions respectively for exerting an expanding force to press the base plate toward a left side wall of the magazine case;

a second elastic body installed between the curved forward end portion of said base plate and the right side wall of said main body and protruding through the window hole on the right side wall of said magazine case for exerting an expanding force to flex said curved forward end portion and thereby straighten the curved forward end portion of the base plate and press it toward the left side wall; and, a plurality of blade bodies which are moved between the left side wall of the magazine case and the base plate through the forward end opening of the magazine case by movement of said slider in said groove.

2. A magazine type knife as claimed in claim 1, wherein the first elastic body is made of a plate spring and the second elastic body is made of a torsion wire spring.

3. A magazine type knife as claimed in claim 1, wherein a part of the second elastic body is secured on the base plate.

4. A magazine type knife as claimed in claim 1, wherein a part of the second elastic body is secured on the magazine case.

5. A magazine type knife as claimed in claim 1, wherein a part of the second elastic body is secured on the main body.

* * * * *